US010151457B2

(12) United States Patent
Liu et al.

(10) Patent No.: US 10,151,457 B2
(45) Date of Patent: Dec. 11, 2018

(54) ASSEMBLING MECHANISM FOR LED DOWNLIGHT

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xiaoyung Liu, Zhejiang (CN); Weibo Li, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/629,847

(22) Filed: Jun. 22, 2017

(65) Prior Publication Data

US 2017/0370558 A1 Dec. 28, 2017

(30) Foreign Application Priority Data

Jun. 22, 2016 (CN) ..... 2016 1 0470769

(51) Int. Cl.

| | |
|---|---|
| ***F21V 17/16*** | (2006.01) |
| ***F21S 8/02*** | (2006.01) |
| ***F21V 31/00*** | (2006.01) |
| ***F21V 3/04*** | (2018.01) |
| ***F21V 3/00*** | (2015.01) |
| ***F21V 17/14*** | (2006.01) |
| ***F21K 9/23*** | (2016.01) |
| ***F21V 3/06*** | (2018.01) |
| *F21Y 115/10* | (2016.01) |

(52) U.S. Cl.

CPC ..... *F21V 17/162* (2013.01); *F21K 9/23* (2016.08); *F21S 8/02* (2013.01); *F21S 8/026* (2013.01); *F21V 3/00* (2013.01); *F21V 3/061* (2018.02); *F21V 17/14* (2013.01); *F21V 17/164* (2013.01); *F21V 31/005* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2005/0225966 | A1* | 10/2005 | Hartmann, Jr. | F21S 8/02 362/147 |
| 2012/0106176 | A1* | 5/2012 | Lopez | F21K 9/00 362/382 |
| 2015/0009679 | A1* | 1/2015 | Seki | G02B 7/022 362/307 |
| 2015/0047452 | A1* | 2/2015 | Wolf | B25J 17/0275 74/490.05 |
| 2016/0161096 | A1* | 6/2016 | Boulanger | F21V 21/02 362/368 |

* cited by examiner

*Primary Examiner* — Ashok Patel

(74) *Attorney, Agent, or Firm* — Wang Law Firm, Inc.

(57) ABSTRACT

An assembling mechanism for LED downlight includes a cylindrical body, at least one spring fixed on the cylindrical body, and a cover assembled on the at least one spring. Each of the at least one spring includes a fixing portion, a reed extending from the fixing portion along a rotation direction of the cylindrical body, and a catching portion disposed on the reed. The catching portion extends along the radial direction of the cylindrical body. The cover includes at least one clamping gap. Each of the at least one clamping gap includes an open provided along the rotation direction of the cylindrical body. The catching portion is inserted into the clamping gap from the opening by rotating the cover.

7 Claims, 4 Drawing Sheets

ASSEMBLING MECHANISM FOR LED DOWNLIGHT

RELATED APPLICATION

This present application claims benefit of the Chinese Application, CN 201610470769.9, filed on Jun. 22, 2016.

BACKGROUND

1. Technical Field

The present application relates to a lighting device, and more particularly to an assembling mechanism for LED downlight.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of LED strip lamps. Moreover, in addition to lighting equipments, such as general traffic lights, billboards, motor-lights, etc., also use light-emitting diodes as light source. As described above, for the light-emitting diodes as a light source, the advantage is power saving, and the greater brightness. Therefore, the use has been gradually common. In particular, with the integration of multiple LED chips into a high-power light source, such as COB (Chip on Board), LED lighting has entered a development stage of much smaller size, more power, and better converging.

However, because of the smaller size, it is difficult to fix or assemble the various components of LED lamps, especially LED downlights, in the default installation location. In these LED downlights, it increases a variety of parts, such as reflective cups, seals, anti-glare and other parts, and a variety of functions, such as a rotation function, light shielding efficiency, and waterproof features, and so on, due to the improvement of lighting effects. As a result, it makes the assembly more and more complex and is more and more difficult to fix or assemble the various parts. Moreover, the various parts of many downlights at the factory are fixed between each other by the detecting thereof. However, after long-distance transport, many transshipment, and distribution, the various parts are loose, or even failure when these lights reach the hands of the end users.

Therefore, it is necessary to provide an assembling mechanism for LED downlight which makes it possible to solve the above problems.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
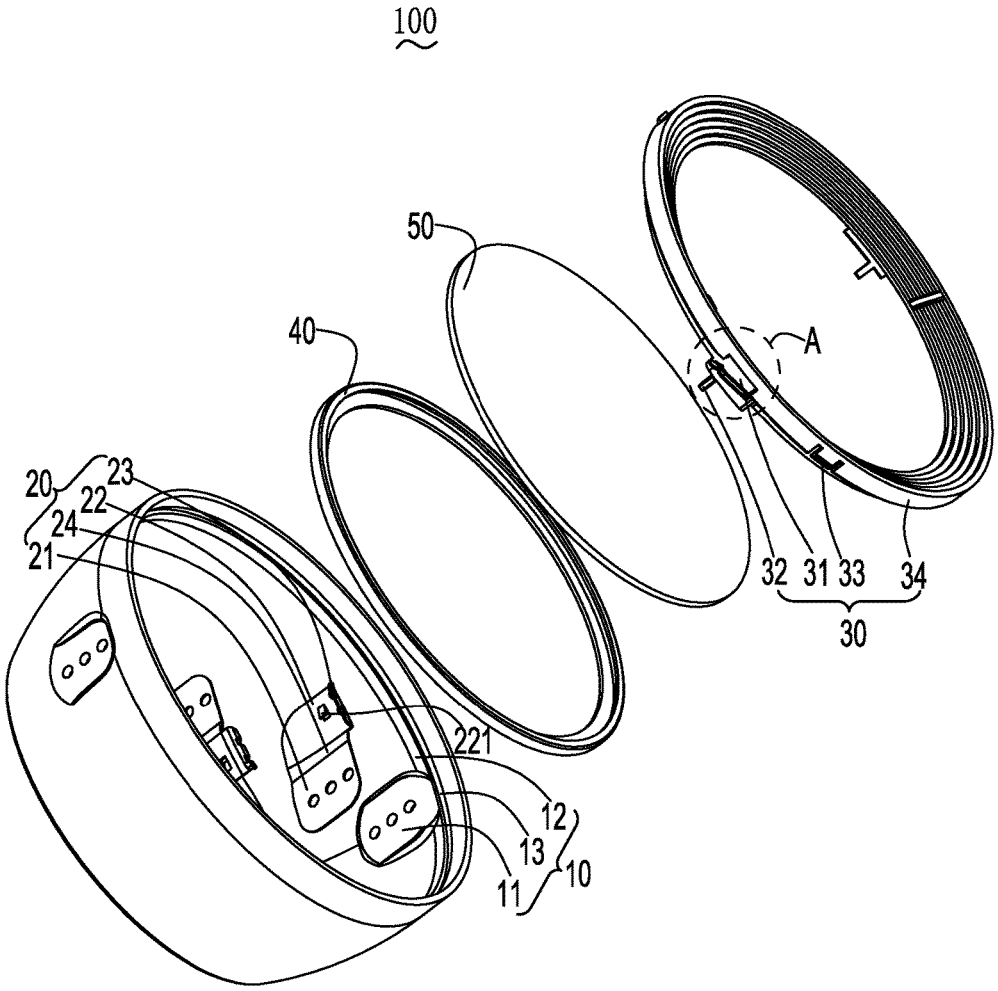
FIG. 1 is an explored view of an assembling mechanism for LED downlight according to an embodiment.
Figure 2:
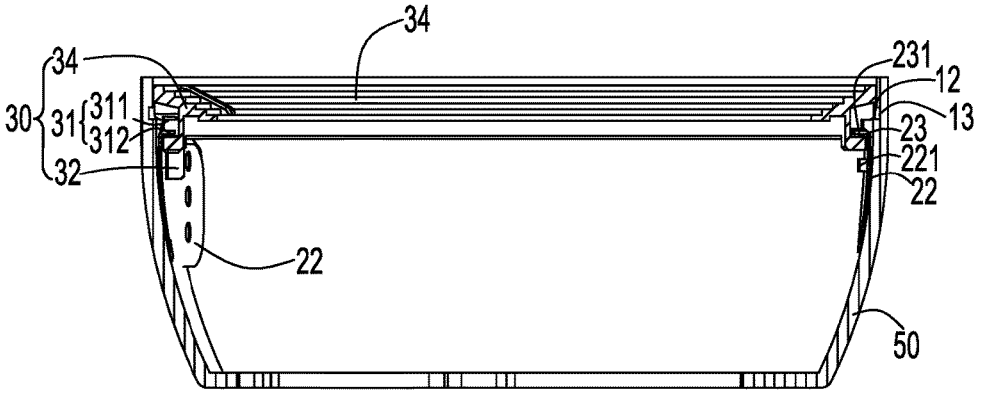
FIG. 2 is a cross sectional view of the assembling mechanism for LED downlight of FIG. 1.

Referring to FIG. 1 to FIG. 2, an assembling mechanism 100 for LED downlight is shown. The assembling mechanism 100 for LED downlight includes a cylindrical body 10, at least one spring 20 fixed on the cylindrical body 10, a cover 30 mounted on the spring 20, a sealing strip 40 disposed on the cylindrical body 10, and a glass window 50 interposed between the sealing strip 40 and the cover 30. It can be understood that the LED downlight further includes other function modules, such as heat-dissipation module, rotating module, light source module, power supply module, reflective cup, and so on. However, these function modules are well known for these skilled in the art and not described in detail.

The cylindrical body 10 may be a circular cylindrical, or otherwise of a cylindrical shape, such as a square or the like. In the present embodiment, the cylindrical body 10 is a circular cylindrical. The cylindrical body 10 is configured for mounting other components, such as the light source module, the heat-dissipation module, the rotating module, and the cover 30. In order to ensure the strength of the cylindrical body 10, it is usually made of metal material, such as aluminum alloy, or the like. Two platforms 11 are provided on the cylindrical body 10 and are stamped or compression molded. A step 12 may be further provided on the cylindrical body 10 and is configured for arranging the sealing strip 40. A slot 13 is further opened on the inner side of the cylindrical body 10. The specific structure and functions of the platform 11, the step 12 and the slot 13 will be described separately as below.

Figure 3:
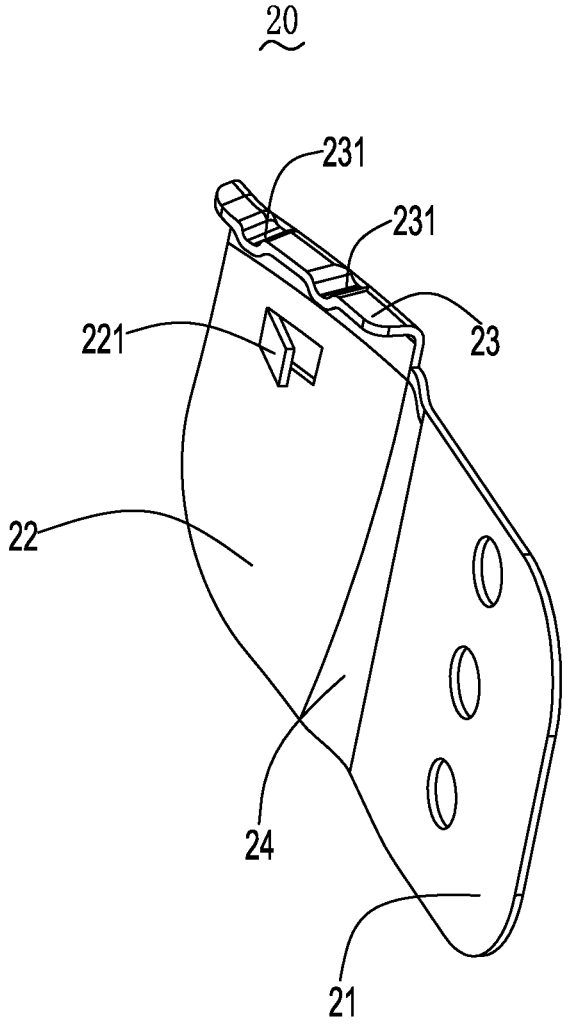
FIG. 3 is an isometric view of a spring of the assembling mechanism for LED downlight of FIG. 1.

As shown in FIG. 3, the assembling mechanism 100 may have one or more the springs 20. In the present embodiment, the assembling mechanism 100 includes two springs 20. The two springs 20 are respectively fixed on the platforms 11 of the cylindrical body 10 by bolts (not labeled). The springs 20 may be made of steel sheet, such as high manganese steel, in order to maintain elasticity. Each of the two springs 20 includes a fixing portion 21, a reed 22 extending from the fixing portion 21 along the turning direction of the cylindrical body 10, and a catching portion 23 disposed on the reed 22. The fixing portion 21 is fixed on the platform 11 of the cylindrical body 10 by the bolt so as to fix the whole spring 20. In order to secure to fix the fixing portion 21, the platform 11 protrudes out of the inner wall of the cylindrical body 10 and has a flat surface. The reed 22 may be deformed by an external force and extends along the turning direction of the cylindrical body 10 so that it is able to abut against the inner wall of the cylindrical body 10 to avoid interference with other components. In the present embodiment, due to the presence of the platform 11, a folding portion 24 is provided between the fixing portion 21 and the reed 22 so that the reed 22 can abut against the inner wall of the cylindrical body 10. The catching portion 23 extends along the radial direction of the cylindrical body 10. The catching portion 23 has a wavy shape and has at least one trough 231. The specific structure and operation principle of the catching portion 23 will be described as follow. In order to prevent the cover 30 from rotating in the reverse direction, an overhead hook 221 is provided on the reed 22. The overhead hook 221 can be directly press-molded from the reed 22, i.e., as tongue formed on the reed 22. The operating principle of the overhead hook 221 will also be described in detail below.

The cover 30 is assembled onto the cylindrical body 10. In the present embodiment, since the cylindrical body 10 has a circular cylindrical, the cover 30 has a shape of circle. If the cylindrical body 10 is not circular, it is also possible to achieve the purpose of rotation as long as the cover 30 has a circular portion. The cover 30 includes a body 34, at least one clamping gap 31, at least one stop bar 32 disposed on an outer side of the clamping gap 31, and at least one barb 33 provided on the body 34. The cover 30 may be injection-molded from a material such as plastic as it has a complicate structure. The body 34 has a circular frame and further provides some anti-glare device.

Figure 4:
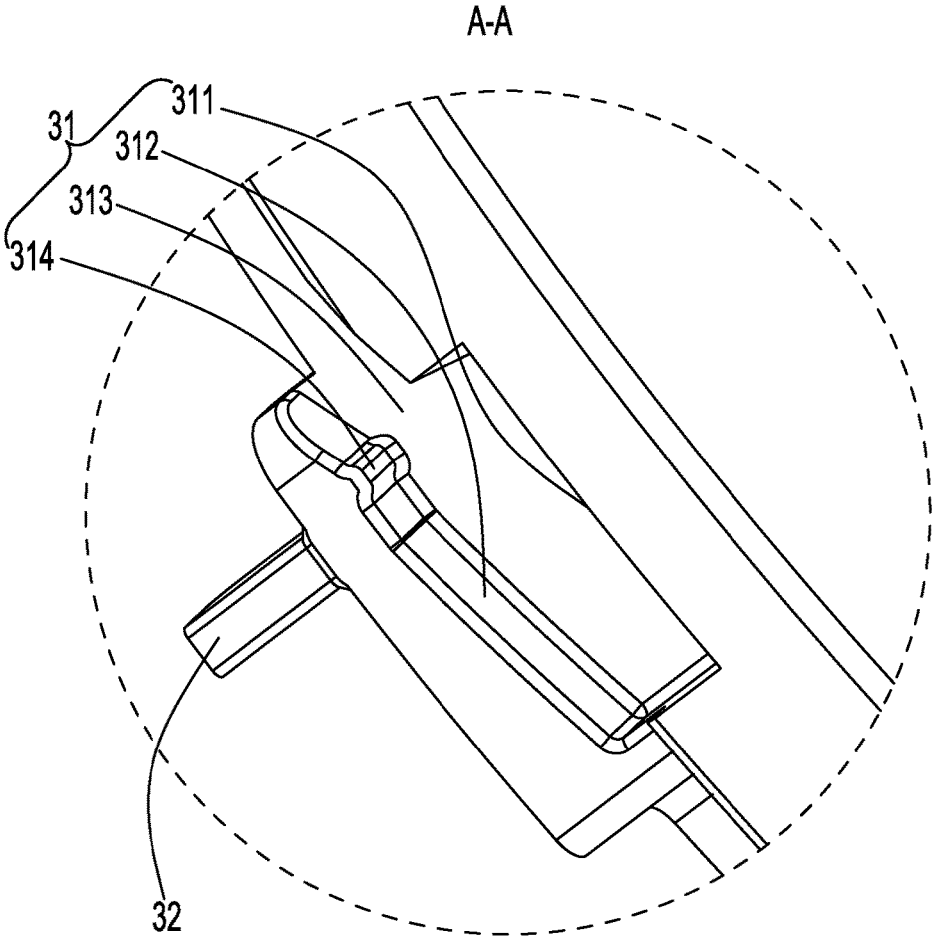
FIG. 4 is a partial enlarge view of the assembling mechanism for LED downlight at A.

As shown in FIG. 4, each of the clamping gaps 31 includes a upper side wall 311, a bottom side wall 312 spaced apart from the upper side wall 311, and an open 313 provided between the upper side wall 311 and the bottom side wall 312. The upper side wall 311 is spaced apart from the bottom side wall 311 so as to form a gap for receiving the catching portion 23. It is needs to be further explained that the upper and lower side walls 311, 312 are opposed to each other only for the distinction of names, and there is no practical meaning or position limitation. The bottom side wall 312 has a slope. The slope inclines along the rotation direction of the cylindrical body 10. Therefore, when the catching portion 23 is inserted into the gap between the upper and bottom side walls 311, 312 by rotating the cover 30, the catching portion 23 will be further embed into the gap and become more and more tight until it cannot be rotated. The open 313 is provided along the rotation direction of the cylindrical body 10 so that the catching portion 23 can be inserted between the upper and bottom side walls 311, 312 therefrom. A protrude 314 is provided on the bottom side wall 312 near the open 313. When the catching portion 23 is inserted into the clamping gap 31, the protrude 314 can engage into the trough 231 of the catching portion 23 so as to further fix the position relationship of the cover 30 and the cylindrical body 10. In order to allow the catching portion 23 to be fully inserted into the clamping gap 31 so that the clamping gap 31 can fix the relative position of the catching portion 23 in the rotational direction of the cylindrical body 10, the length of the catching portion 23 is equal to that of the clamping gap 31 along the rotation direction of the cylindrical body 10.

The stop bar 32 extends toward the cylindrical body 10 along an axial direction of cylindrical body 10. Due to the action of the overhead hook 221 provided on the reed 22, the stop bar 32 press the overhead hook 221 so that the catching portion 23 can pass over the overhead hook 221 and is received in the clamping gap 31 during the catching portion 23 is inserted into the clamping gap 31. However, when the catching portion 23 is rotated in the reverse direction by an external force, it is difficult to press the overhead hook again. As a result, the overhead hook 221 can prevent the stop bar 32 from rotating after the assembling is completed, which will results in a loose.

The barb 33 extends toward the cylindrical body 10 along the axial direction of the cylindrical body 10. When the cover 30 is assembled onto the end of the cylindrical body 10, the barb 33 will be inserted into the inside of the cylindrical body 10 and is hooked into the slot 13 of the cylindrical body 1 to further prevent the cylindrical cover 30 from moving in the axial direction of the cylindrical body 10. Therefore, the hook of the barb 33 will project the body 34 of the cover 30 and a maximum diameter of the hook of the barb 33 is equal to the diameter of the slot 13.

The sealing strip 40 is disposed on the step 12 of the cylindrical body 10 and may be made of flexible material. When the cover 30 is rotated, the sealing strip 40 will be deformed under the extrusion of the glass window 50 so that it can act as a waterproofing member. In addition, since the sealing strip 40 is deformed under extrusion and has a restoring force, the restoring force is transmitted between the cover 30 and the spring 20, and the barb 33 of the cover 30 and the slot 13 of the cylindrical body 10 so as to further enhance the coupling force between the cover 30 and the cylindrical body 10.

The glass window 50 is clamped between the sealing strip 40 and the cover 30 and is used as an exit window of light and to protect the components received in the cylindrical body 10.

Since the assembling mechanism 100 for LED downlight has the clamping gap 31 of the cover 30 and the spring 20 disposed on the cylindrical body 10, and the catching portion 23 is provided on the spring 20, the spring 20 can prevent the cover 30 loosing along the rotation direction of the cylindrical body 10 after the catching portion 23 is inserted into the clamping gap 31. As a result, the relative position between the various parts can be fixed so as to prevent the LED downlight from loosing, or even failing in the transport, distribution, and other sales.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An assembling mechanism for LED downlight, comprising:

a cylindrical body;

at least one spring fixed on the cylindrical body, each of the at least one spring comprising a fixing portion, a reed extending from the fixing portion along a rotation direction of the cylindrical body, and a catching portion disposed on the reed, the catching portion extending along a radial direction of the cylindrical body; and a cover assembled on the at least one spring, the cover comprising at least one clamping gap, each of the at least one clamping gap comprising an open provided along the rotation direction of the cylindrical body, the catching portion being inserted into the clamping gap from the opening by rotating the cover, wherein an overhead hook is provided on the reed, the cover comprises a stop bar disposed on an outer side of the clamping gap, the stop bar extends along the axial direction of the cylindrical body, and the overhead hook is locked on the stop bar so as to prevent the cover from rotating around the cylindrical body, wherein the cover further comprises at least one barb provided thereon, the cylindrical body comprises a slot disposed in an inner side wall thereof, and each of the at least one barb is hooked into the slot of the cylindrical body to prevent the cover from moving in the axial direction of the cylindrical body.

2. The assembling mechanism for LED downlight as claimed in claim 1, wherein the clamping gap further comprising an upper side wall along an axial direction of the cylindrical body, and a bottom side wall spaced apart from the upper side wall, the catching portion is inserted between the upper and bottom side walls.

3. The assembling mechanism for LED downlight as claimed in claim 2, wherein the bottom side wall has a slope, and the slope inclines along the rotation direction of the cylindrical body.

4. The assembling mechanism for LED downlight as claimed in claim 2, wherein a protrude is provided on the bottom side wall near the open, the catching portion has a wavy shape and has at least one trough, the protrude is engaged into the trough.

5. The assembling mechanism for LED downlight as claimed in claim 1, wherein the length of the catching portion is equal to that of clamping gap along the rotation direction of the cylindrical body so as to fix the position relationship of the cylindrical body and the cover along the rotation direction of the cylindrical body.

6. The assembling mechanism for LED downlight as claimed in claim 1, wherein the assembling mechanism further comprises a sealing strip, and a glass window clamped between the cover and the sealing strip.

7. The assembling mechanism for LED downlight as claimed in claim 6, wherein a step is provided on the cylindrical body and is configured for mounting the sealing strip.

* * * * *